US008248321B2

(12) United States Patent
Anderson et al.

(10) Patent No.: US 8,248,321 B2
(45) Date of Patent: Aug. 21, 2012

(54) BROADBAND/MULTI-BAND HORN ANTENNA WITH COMPACT INTEGRATED FEED

(75) Inventors: Joseph M. Anderson, Tucson, AZ (US); Todd Hatch, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 455 days.

(21) Appl. No.: 12/552,231

(22) Filed: Sep. 1, 2009

(65) Prior Publication Data

US 2011/0050527 A1 Mar. 3, 2011

(51) Int. Cl.
*H01Q 13/00* (2006.01)

(52) U.S. Cl. ..... 343/786; 343/772

(58) Field of Classification Search ..... 343/786, 343/772; 333/125, 126
See application file for complete search history.

(56) References Cited

U.S. PATENT DOCUMENTS

| | | | | |
|---|---|---|---|---|
| 3,325,817 | A | 6/1967 | Ajioka | |
| 3,380,057 | A | 4/1968 | Osborn | |
| 3,389,394 | A | 6/1968 | Lewis | |
| 3,566,309 | A | 2/1971 | Ajioka | |
| 3,742,506 | A | 6/1973 | Wilkinson | |
| 3,978,434 | A | 8/1976 | Morz et al. | |
| 4,792,814 | A | 12/1988 | Ebisui | |
| 4,821,046 | A * | 4/1989 | Wilkes | 343/786 |
| 4,876,061 | A | 10/1989 | Nusair | |
| 5,406,298 | A | 4/1995 | Walters | |
| 6,603,438 | B2 | 8/2003 | Strickland | |
| 6,624,792 | B1 | 9/2003 | Chu | |
| 6,906,676 | B2 | 6/2005 | Killen et al. | |
| 6,937,203 | B2 | 8/2005 | Rao et al. | |
| 7,161,550 | B2 | 1/2007 | McLean et al. | |

OTHER PUBLICATIONS

World Intellectual Property Organization, International Search Report and Written Opinion for PCT Application No. PCT/US2010/041620, Mail Date Sep. 23, 2010, pp. 1-6.
R. Rehdasht-Heydari, H.R. Hasani, A.R. Mallahzadeh, "Quad Ridged Horn Antenna for Uwb Applications", , Electrical Engineering Department, Shahed University, Tehran, Iran, Progress in Electromagnetics Research, PIER 79, 23-38, 2008.
Notification Concerning Transmittal of International Preliminary Report on Patentability (Chapter I of the Patent Cooperation Treaty) dated Mar. 15, 2012, PCT/US2010/041620, 1 page.
International Preliminary Report on Patentability dated Mar. 6, 2012, PCT/US2010/041620, 1 page.
Written Opinion of the International Searching Authority, PCT/US2010/041620, 4 pages.

* cited by examiner

*Primary Examiner* — Hoang V Nguyen
(74) *Attorney, Agent, or Firm* — Daly, Crowley, Mofford & Durkee, LLP

(57) ABSTRACT

A dual polarization multi-band antenna may include a waveguide horn, a low band feed section, a transition section, and a high band feed section coupled in series. The waveguide horn may be configured to support propagation of electromagnetic waves in a low band and a high band. The low band feed section may include horizontal and vertical feeds and may be configured to support propagation of electromagnetic waves in the low band and the high band. The high band feed section may include horizontal and vertical feeds and may be configured to support propagation of electromagnetic waves in the high band but not in the low band. The transition section may be configured to couple electromagnetic waves in the high band from the high band feed section to the low band feed section and to constructively reflect electromagnetic waves in the low band.

13 Claims, 9 Drawing Sheets

BROADBAND/MULTI-BAND HORN ANTENNA WITH COMPACT INTEGRATED FEED

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to multi-band and broadband microwave antennas.

2. Description of the Related Art

The microwave portion of the electromagnetic spectrum includes a plurality of defined frequency bands commonly used for radar and communications systems. For example, the Institute of Electrical and Electronic Engineers defines a series of "radar bands" including the C band from 4 to 8 GHz, the X band from 8 to 12 GHz, the Ku band from 12 to 18 GHZ, the K band from 18 to 27 GHz, and the Ka band from 27 to 40 GHz. Within the broadly defined radar bands, specific communications bands may be used for terrestrial and satellite communications. Each of the communications bands may correspond to an atmospheric frequency window, or wavelength range that is transmitted through the atmosphere with relatively low loss. In addition, both radar and communications systems commonly use orthogonally polarized signals within the same frequency band to transmit or receive different information. Thus, many applications require dual polarization broadband or multi-band antennas useable to transmit and/or receive microwave signals in more than one band.

Traditional microwave antennas may use different components to combine or separate signals having different polarization states and different frequencies. For example, the feed network of a traditional dual polarization multi-band antenna may include a diplexer, or frequency multiplexer, to mix or separate signals in two frequency bands, and two band-specific ortho-mode transducers to combine or separate orthogonally polarized signals in each frequency band. The resulting feed network may be costly, mechanically complex, and bulky.

Waveguides and waveguide horns are commonly used to convey and radiate microwave energy. In most applications, the operational bandwidth of a waveguide or waveguide horn is considered to be the range of electromagnetic waves that can propagate within the waveguide as a single fundamental mode or a pair of orthogonal fundamental modes. The addition of conductive ridges in the walls of a waveguide is known to increase the bandwidth of the waveguide.

Throughout this description, elements appearing in figures are assigned three-digit reference designators specific to the element. An element that is not described in conjunction with a figure may be presumed to have the same characteristics and function as a previously-described element having the same reference designator.

DETAILED DESCRIPTION

Description of Apparatus

Figure 1:
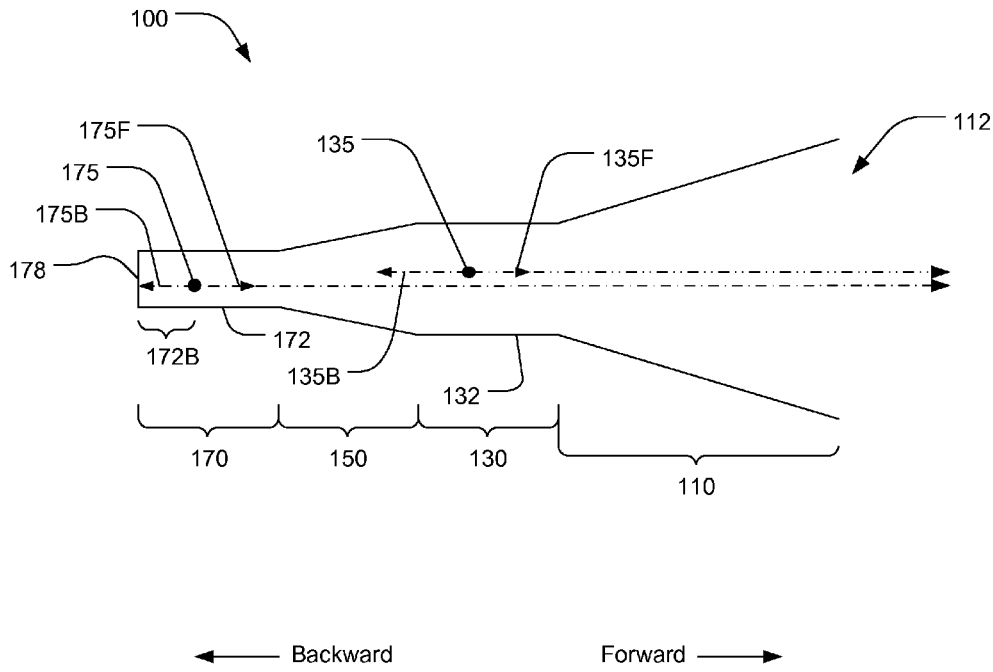
FIG. 1 is a schematic diagram of a dual polarization broadband/multi-band antenna.

Referring now to FIG. 1, a dual polarization broadband/multi-band antenna 100 may include a dual band waveguide horn 110, a low band feed section 130, a transition section 150, and a high band feed section 170. The dual band waveguide horn 110 may have a forward end with a radiating aperture 112 open to free space. As shown in FIG. 1, the term "forward" will be used in this patent to describe a direction towards the radiating aperture of an antenna, and the terms "back" and "backward" will be used to describe the opposing direction. The forward end of an element is in the forward direction and the back end of an element is in the backward direction.

The dual band waveguide horn 110 may be configured to support the propagation of electromagnetic waves in a low band and a high band. In this description, the term "band" means a range of wavelengths and the terms "low" and "high" are relative. The wavelengths contained in the high band are higher than the wavelengths contained in the low band.

A back end of the dual band waveguide horn 110 may be coupled to a forward end of the low band feed section 130. The low band feed section 130 may include a dual band waveguide 132 configured to support the propagation of electromagnetic waves in the low wavelength band and the high wavelength band and at least one low band feed 135 for coupling an electromagnetic waves in the low band into the dual band waveguide 132.

A back end of the low band feed section 130 may be coupled to a forward end of the transition section 150. A back end of the transition section 150 may be coupled to the forward end of the high band feed section 170. The high band feed section 170 may include a high band waveguide 172 configured to support the propagation of electromagnetic waves in the high band, but not in the low band, and at least one high band feed 175 for coupling electromagnetic energy in the high band into the high band waveguide 172.

High band electromagnetic energy coupled into the high band waveguide 172 from the high band feed 175 may propagate as both a forward-propagating high band wave, indicated by the broken line 175F, and a backward-propagating high band wave, indicated by the broken line 175B. The back end of the high band waveguide 172 may be closed by a conductive shorting wall 178 configured to inhibit coupling from the high band feed to the backward-propagating high band wave 175B. The shorting wall 178 may be disposed, with respect to the high band feed 175, such that the back portion 172B of the high band waveguide appears as a high impedance when viewed from the high band feed 175. Since the back portion 172B of the high band waveguide appears as a high impedance, only a small portion of the high band electromagnetic energy may be coupled from the high band feed 175 into the backward-propagating high band wave 175B. The majority of high band electromagnetic energy may be coupled into the forward-propagating high band wave 175F. For example, the back portion 172B of the high band waveguide may appear as a high impedance if the shorting wall 178 is positioned about ¼ of the high band wavelength from the high band feed. The forward-propagating high band wave 175F may propagate through the transition section 150 and the dual band waveguide 132 and be radiated into free space via the dual-band waveguide horn 110.

Similarly, low band electromagnetic energy coupled into the dual band waveguide 132 from the low band feed 135 may be coupled into both a forward-propagating low band wave, indicated by the broken line 135F, and a backward-propagating low band wave, as indicated by the broken line 135B. The transition section 150 may be configured to support through propagation of the high band wave 175F and to inhibit coupling from the low band feed 135 to the backward-propagating low band wave 135B. The transition section 150 may appear to the low band feed 135 as a high impedance, such that only a small portion of the low band electromagnetic energy may be coupled from the low band feed 135 into the backward-propagating low band wave 135B. The majority of low band electromagnetic energy may be coupled into the forward-propagating low band wave 135F. The forward-propagating low band wave 135F may propagate through the dual band waveguide 132 and be radiated into free space via the dual-band waveguide horn 110.

Figure 2:
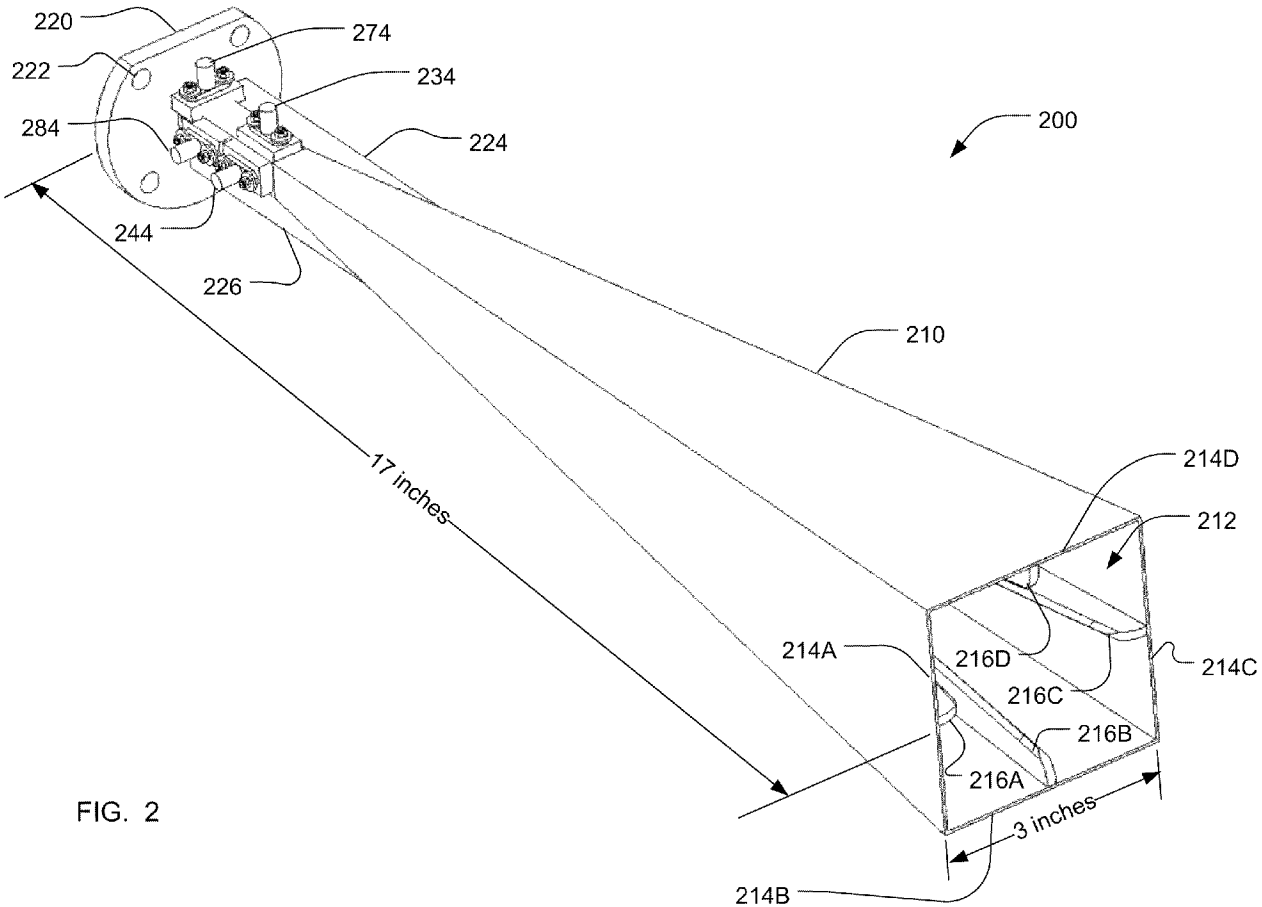
FIG. 2 is a perspective view of a dual polarization broadband/multi-band antenna.

Referring now to FIG. 2, an exemplary dual polarization broadband/multi-band antenna 200, which may be the antenna 100, may include a waveguide horn 210 which terminates at a forward end in a radiating aperture 212. The relative position of various parts of the dual polarization broadband/multi-band antenna 200 will be described using geometrically descriptive terms such as top, bottom, left and right. These terms refer specifically to the orientation as seen in the figures. However, the dual polarization broadband/multi-band antenna 200 may be used in various positions such as upside down. Thus, geometrically descriptive terms are relative and do not imply any absolute orientation of the dual polarization broadband/multi-band antenna 200.

The exemplary dual polarization broadband/multi-band antenna 200 of FIG. 2 is configured to operate in a broad low band from 8 GHz to 18 GHz, encompassing the X and Ku bands, and in a high band from 32 GHz to 36 GHz, encompassing a portion of the Ka band. The overall length of the dual polarization broadband/multi-band antenna 200 may be about 17 inches, and the radiating aperture 212 may be about 3 inches square. Dual polarization broadband/multi-band antennas configured for operation in other bands may have other dimensions.

The waveguide horn 210 may be a quad ridged waveguide horn. The waveguide horn 210 may include four walls 214A, 214B, 214C, 214D which define a waveguide having a generally square cross-section. The cross-section of the dual polarization broadband/multi-band antenna 200 may taper in size from the radiating aperture 212 at the forward end to the rearward end proximate to the flange 220. Four ridges 216A, 216B, 216C, 216D (partially visible through the radiating aperture 212A) may extend into the interior of the waveguide horn 210 from the respective walls.

The back portion of the dual polarization broadband/multi-band antenna 200 may be a feed network, of which only X/Ku band connectors 234, 244 and Ka band connectors 274, 284 are visible in FIG. 2. The two connectors 234, 274 on top of the waveguide horn 210 may be used to couple microwave energy, in their respective bands, having a vertical polarization state. The two connectors 244, 284 on the left side of the waveguide horn 210 may be used to couple microwave energy, in their respective bands, having a horizontal polarization state. The terms "vertical" and "horizontal" indicate two orthogonal directions for the electric field vector of electromagnetic energy propagating in the waveguide horn 210 and do not imply any absolute orientation of the dual polarization broadband/multi-band antenna 200.

The dual polarization broadband/multi-band antenna 200 may be mechanically connected to and supported by a flange 220. The flange 220 may include mounting holes 222 or other provisions for attaching the dual polarization broadband/multi-band antenna 200 to a supporting structure (not shown). Two external ribs 224, 226 may be formed on the right side and bottom of the waveguide horn to couple the weight of the waveguide horn 210 to the flange 220 and to strengthen and stiffen the mechanical structure of the dual polarization broadband/multi-band antenna 200. The use of the flange 220 and ribs 224, 226 to mount and support the waveguide horn 210 is exemplary. The dual polarization broadband/multi-band antenna 200 may be supported and mounted by some other structure.

Figure 3:
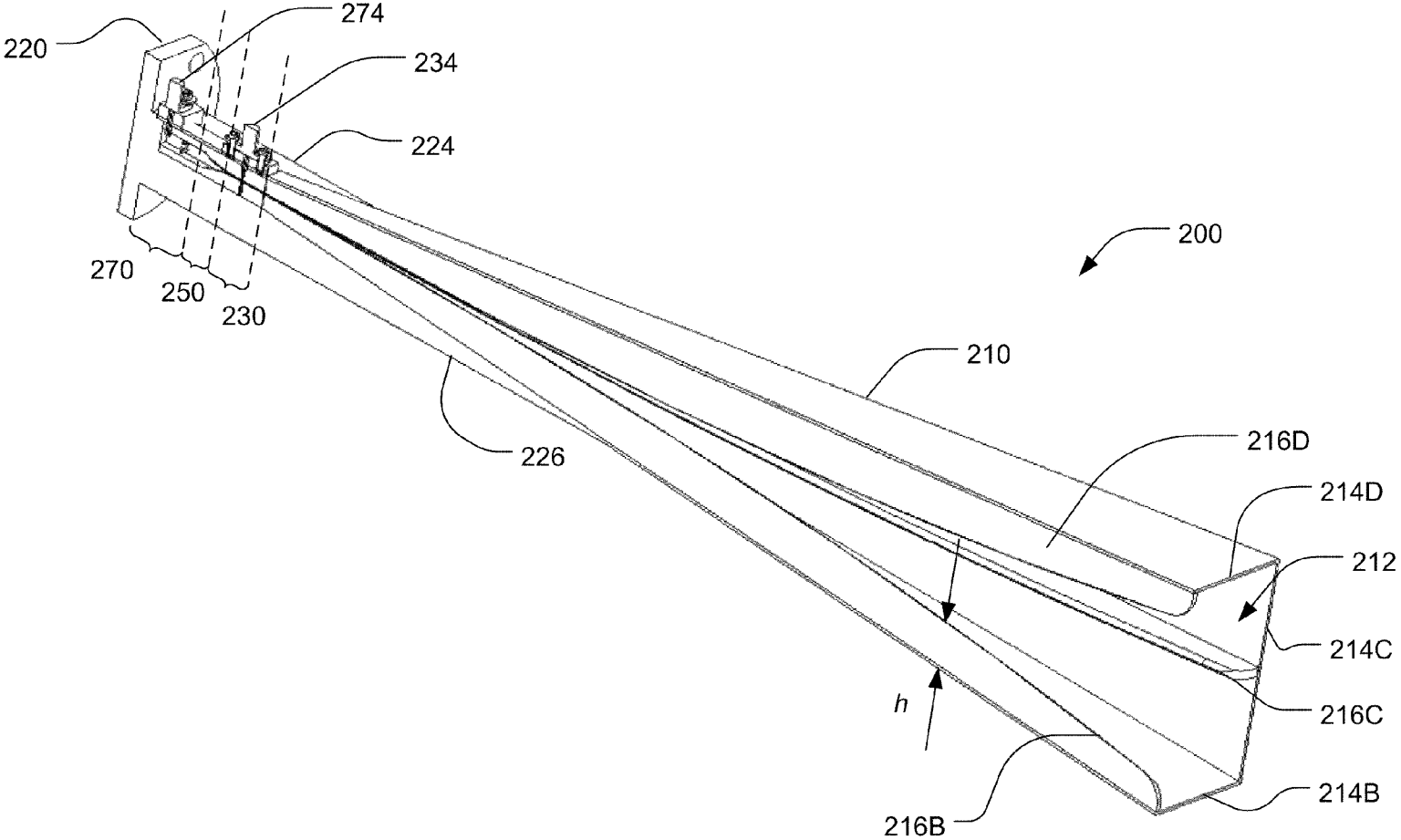
FIG. 3 is a perspective cross-sectional view of the dual polarization broadband/multi-band antenna.

FIG. 3 is a cross-sectional view of the dual polarization broadband/multi-band antenna 200. For ease of description, the dual polarization broadband/multi-band antenna 200 may be partitioned into functional components including the waveguide horn 210, and the feed network including a low band feed section 230, a transition section 250, and a high band feed section 270. This partition of the components of the dual polarization broadband/multi-band antenna 200 into functional components does not imply that the functional components are physically separable or separately fabricated.

The interior structure of the waveguide horn 210, including walls 214B, 214C, 214D and corresponding ridges 216B, 216C, 216D, can be seen in FIG. 3. Each of the four ridges has a height h that varies or tapers with position along the length of the waveguide horn 210. The flare of the waveguide horn 210 and the taper of the ridges 216B-D may be determined using conventional design techniques given the required bandwidth (including both the low band and the high band) and desired gain for the dual polarization broadband/multi-band antenna 200.

The dual polarization broadband/multi-band antenna 200 may be designed and simulated using a software tool adapted to solve three-dimensional electromagnetic field problems. The software tool may be a commercially available electromagnetic field analysis tool such as CST Microwave Studio™, Agilent's Momentum™ tool, or Ansoft's HFSS™ tool. The electromagnetic field analysis tool may be a proprietary tool using any known mathematical method, such as finite difference time domain analysis, finite element method, boundary element method, method of moments, or other methods for solving electromagnetic field problems. The software tool may include a capability to iteratively optimize a design to meet predetermined performance targets.

Figure 4:
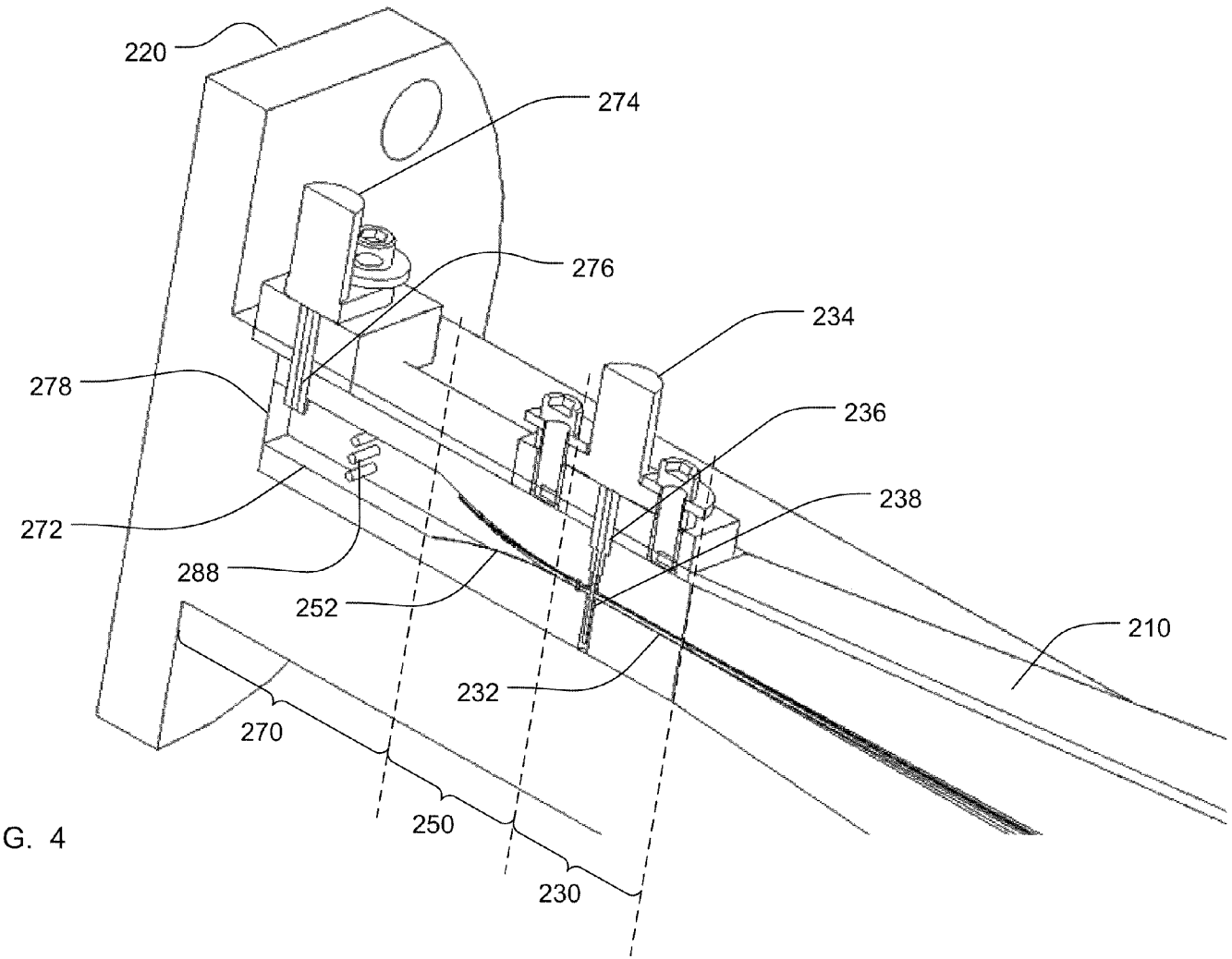
FIG. 4 is a partial perspective cross-sectional view of a feed network.

FIG. 4 is a perspective cross sectional detail view of the dual polarization broadband/multi-band antenna 200 at a section plane passing through the low band vertical polarization feed connector 234 and the high band vertical polarization feed connector 274.

The low band feed section 230 may include a dual band waveguide 232 configured to support propagation of both low band and high band electromagnetic waves. The dual band waveguide 232 may be, for example, a quad ridged waveguide of essentially the same cross section as the back end of the waveguide horn 210. A low band vertical polarization feed may include a probe 238 inserted into the dual band waveguide 232. The probe 238 may be coupled to the low band vertical polarization connector 234 through one or more coaxial transformers 236. The one or more coaxial transformers may match the impedance of the probe to the impedance of a standard coaxial cable to be connected to the connector 234. When the dual band waveguide 232 is a quad ridged waveguide, as shown in FIG. 4, slots may be cut into two opposing ridges to allow insertion of the probe 238.

The high band feed section 270 may include a high band waveguide 272 configured to support propagation of high band electromagnetic waves but not support propagation of low band electromagnetic waves. The high band waveguide 272 may be, for example, a square waveguide as shown in FIG. 4. A high band vertical polarization feed may include a probe 276 inserted into the high band waveguide 272. The high band vertical polarization feed probe 276 may be coupled directly to the high band vertical polarization connector 284. The back end of the high band waveguide 272 may be closed by a conductive shorting plate 278. The shorting plate 278 may be disposed, with respect to the high band vertical polarization feed probe 276, such that the shorting plate inhibits coupling from the high band vertical polarization feed probe 276 to a backward-propagating high band vertical polarized wave. For example, a longitudinal distance between the high band vertical polarization feed probe 276 and the shorting plate 278 may be about ¼ wavelength for the high band.

The high band feed section 270 may also include a plurality of horizontal shorting pins 288 positioned forward of the high band vertical polarization feed probe 276. The shorting pins 288 may be transparent to forward-propagating vertical polarization waves. As will be described, the shorting pins 288 may be effective to inhibit coupling from a high band horizontal polarization feed probe (not visible in FIG. 4) to a backward-propagating high band horizontal polarized wave.

The forward end of the transition section 250 may have a cross-sectional form essentially the same at that of the dual-band waveguide 232. The forward end of the transition section may be a quad ridge waveguide as shown in FIG. 4. The height of the ridges 252 extending from the four walls may taper such that the ridges disappear before the back end of the transition section joins the high band wave guide 272. The taper of the ridges 252 in the transition section may be exponential, as shown in FIG. 4, stepped, linear, or some other taper. The taper of the ridges 252 may be configured such that the transition section 250 appears, from the low band feed probe, as a high impedance that inhibits coupling into backward-propagating low band electromagnetic waves.

Figure 5:
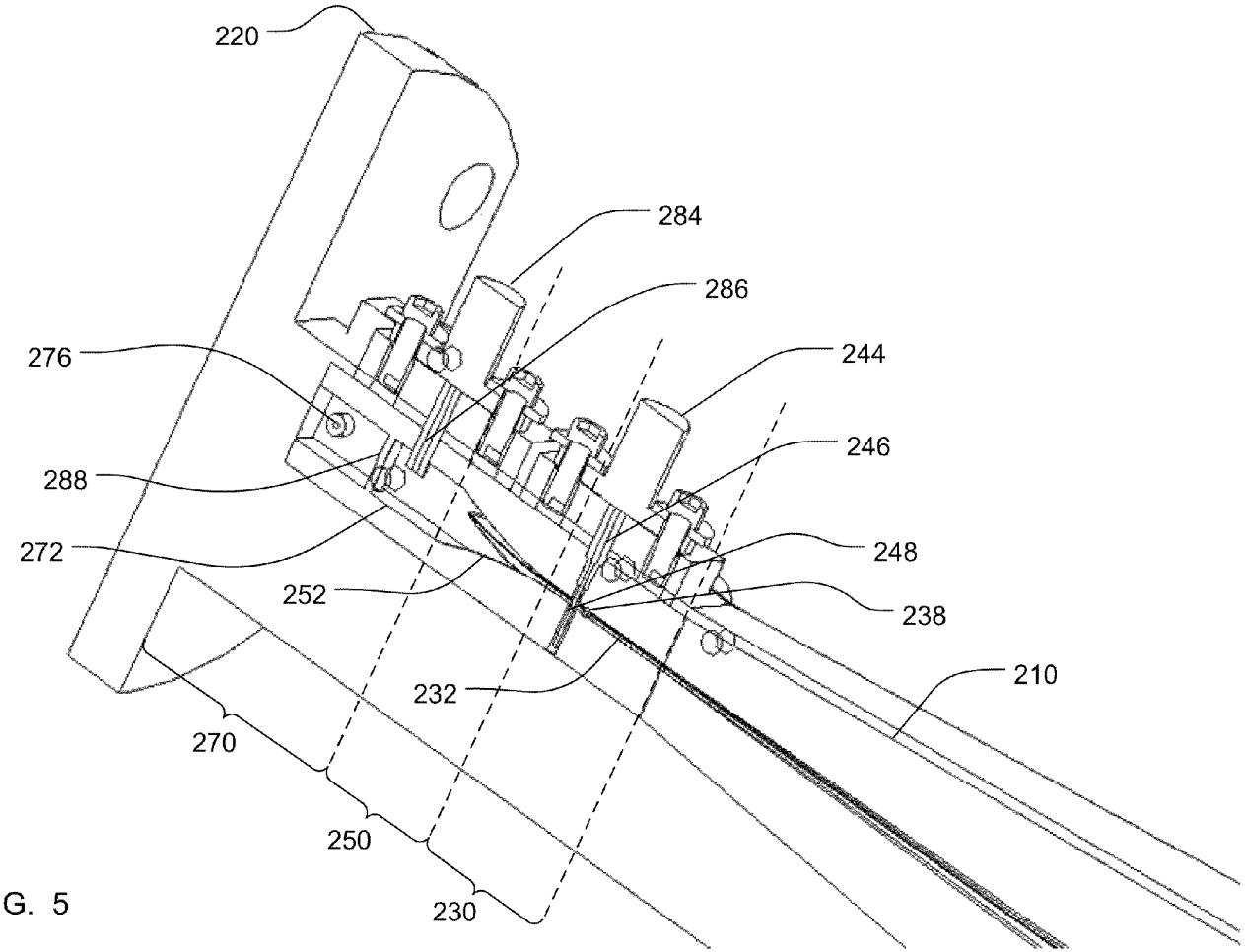
FIG. 5 is a partial perspective cross-sectional view of the feed network, orthogonal to the view of FIG. 4.

FIG. 5 is a perspective cross sectional detail view of the dual polarization broadband/multi-band antenna 200 at a section plane passing through the low band horizontal polarization feed connector 244 and the high band horizontal polarization feed connector 284.

The low band horizontal polarization feed may include a probe 248 inserted into the dual band waveguide 232. The probe 248 may be coupled to the low band horizontal polarization connector 244 through one or more coaxial transformers 246 that match the impedance of the probe to the impedance of a standard coaxial cable to be connected to the connector 244. The low band horizontal polarization feed may be essentially the same as the low band vertical polarization feed except for a slight longitudinal offset between the low band horizontal polarization feed probe 248 and the low band vertical polarization feed probe 238. To allow the transition section to inhibit coupling from the low band horizontal polarization feed probe 248 and the low band vertical polarization feed probe 238 into backward-propagating low band waves, the longitudinal offset between the low band horizontal polarization feed probe 248 and the low band vertical polarization feed probe 238 may be small compared to ¼ wavelength at the low band.

The high band horizontal polarization feed may include a probe 286 inserted into the high band waveguide 272. The probe 286 may be coupled directly to the high band vertical polarization connector 284. The high band horizontal polarization feed probe 286 may be disposed, with respect to the shorting pins 288, such that the shorting pins 288 are effective to inhibit coupling from the high band horizontal polarization feed probe 286 to a backward-propagating high band wave. For example, a longitudinal distance between the high band horizontal polarization feed probe 286 and the shorting pins 288 may be about ¼ wavelength at the high band.

Figure 6:
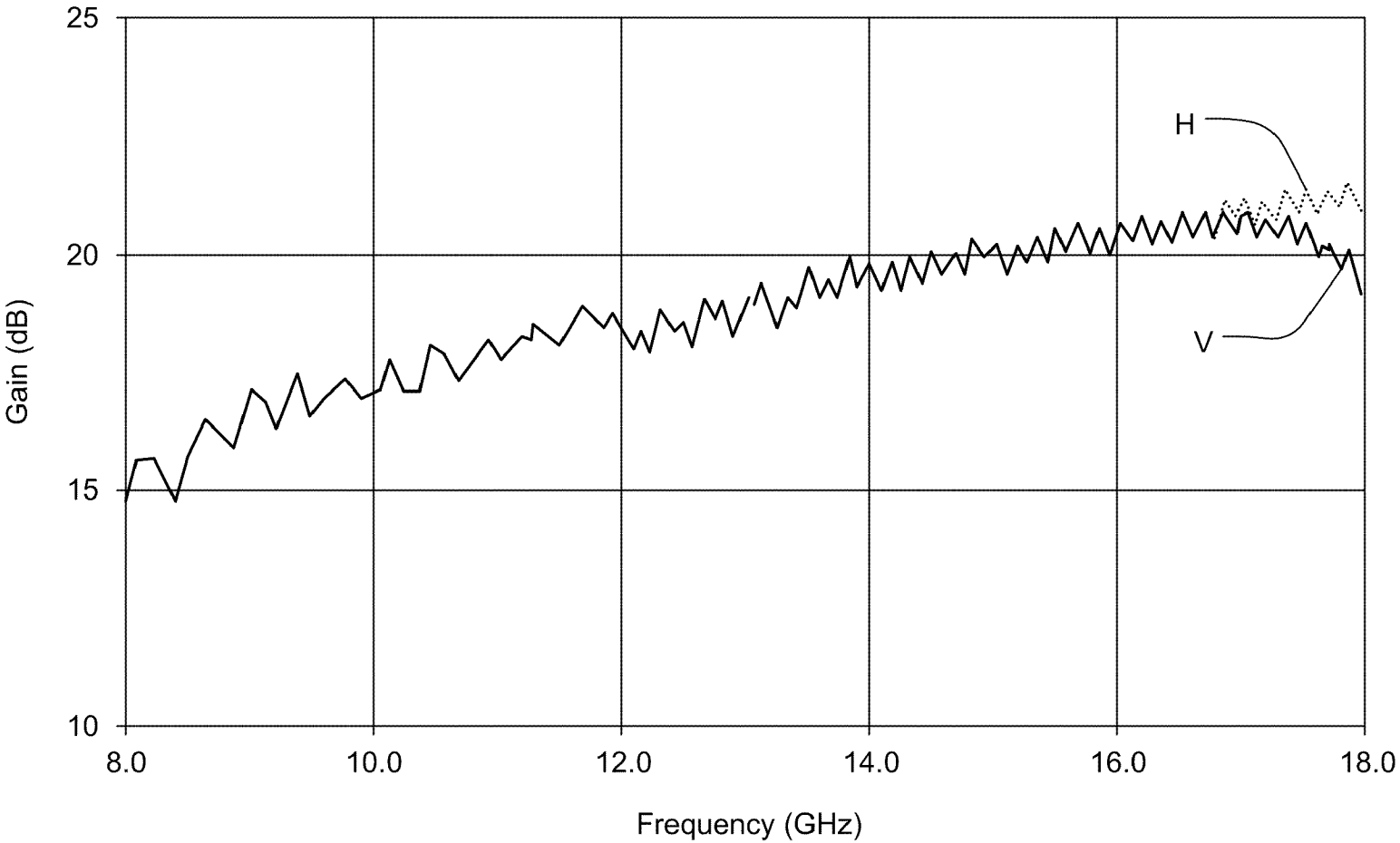
FIG. 6 is a chart showing measured performance of an exemplary dual polarization broadband/multi-band antenna over the X and Ku bands.
Figure 7:
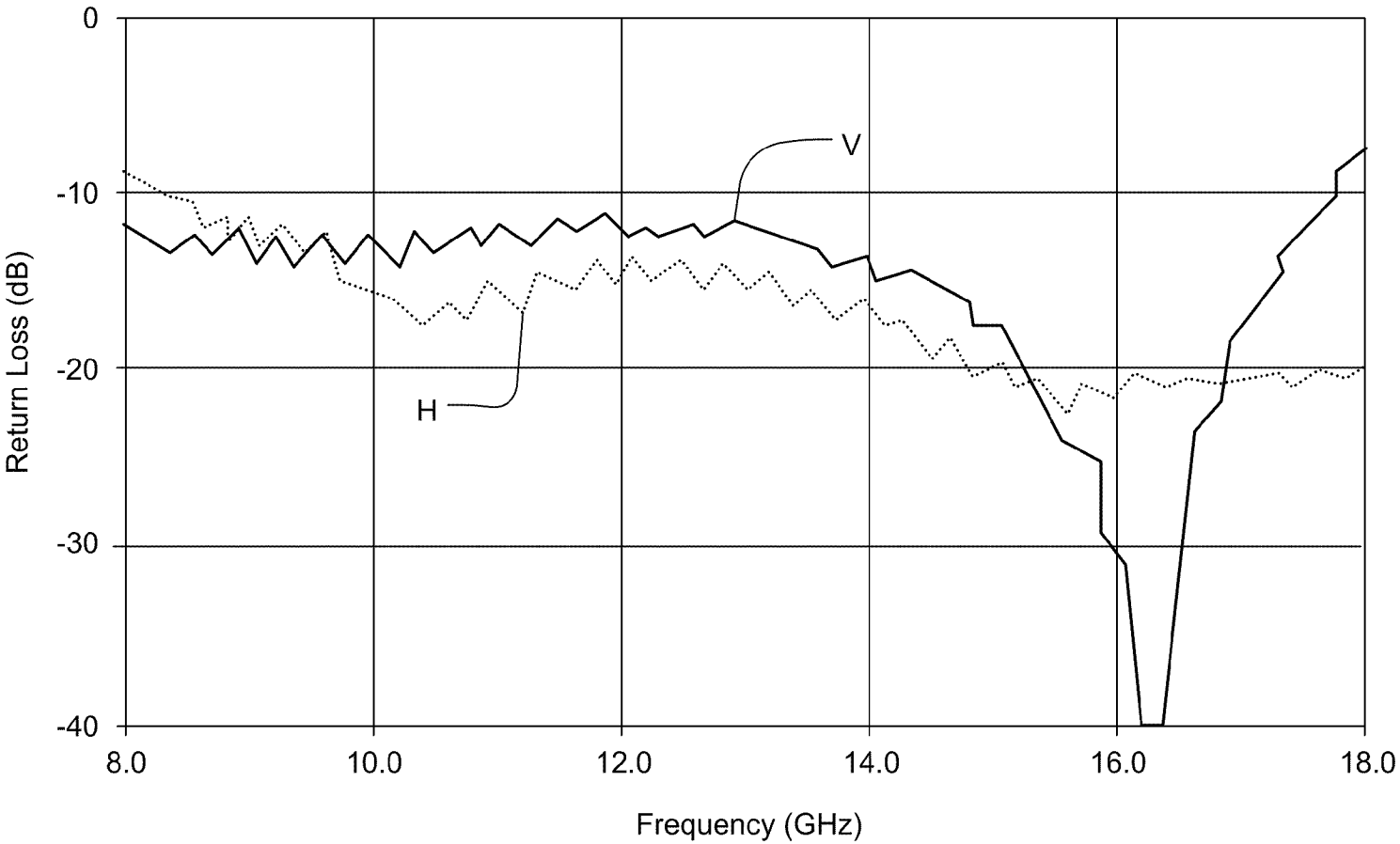
FIG. 7 is a chart showing measured performance of the exemplary dual polarization broadband/multi-band antenna over the X and Ku bands.

FIG. 6 and FIG. 7 are graphs of the measured X-band and Ku-band performance of a prototype dual polarization broadband/multi-band antenna similar to the antenna 200 shown in FIG. 2. As graphed in FIG. 6, the gain of the antenna varies from about 15 dB at 8 GHz to about 20 dB at 18 GHz. The gain is essentially the same for both vertical and horizontal polarization from 8 GHz to about 17 GHz. As graphed in FIG. 7, the return loss is less than −10 dB over nearly the entire 8 GHz-18 GHz frequency range.

Figure 8:
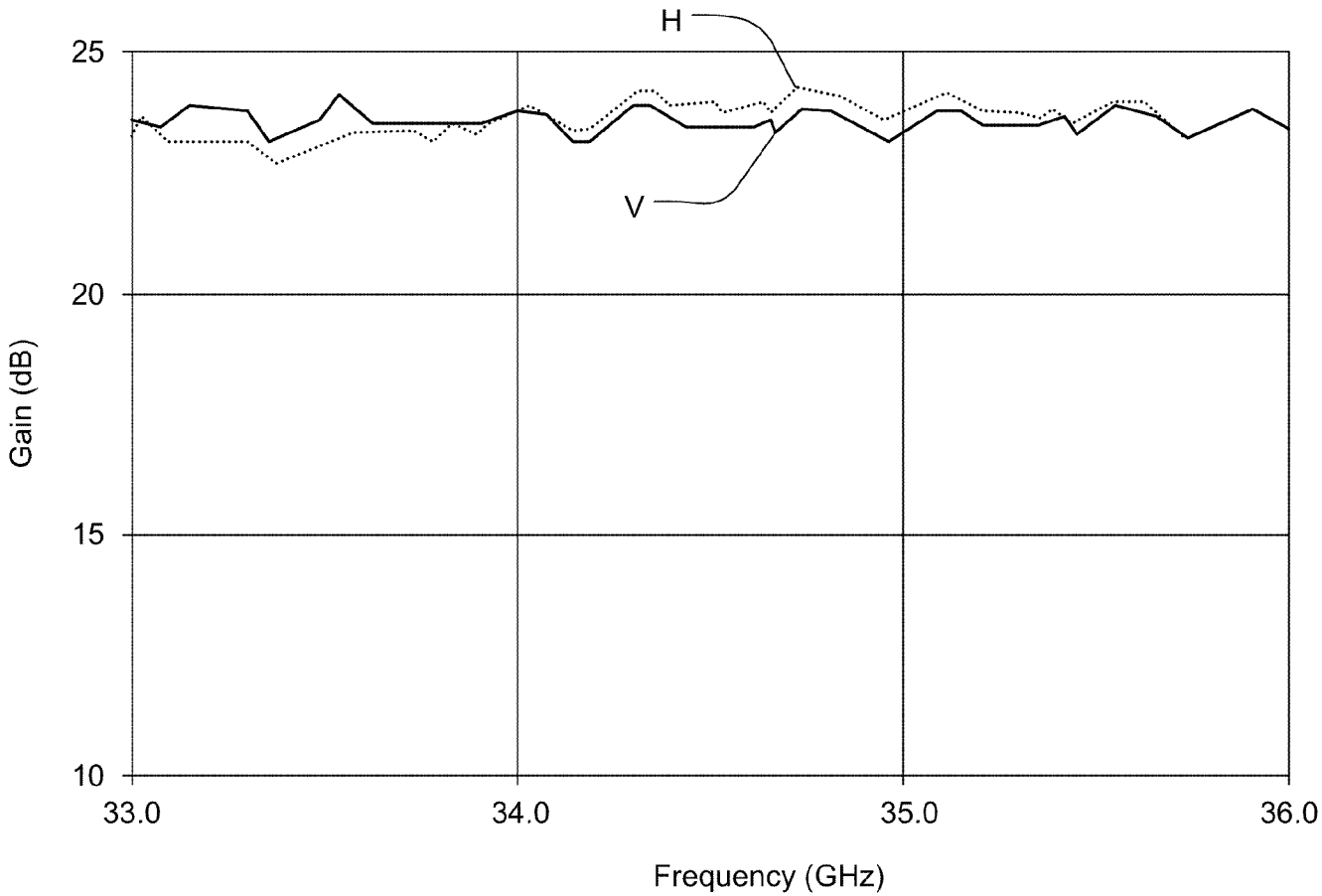
FIG. 8 is a chart showing measured performance of the exemplary dual polarization broadband/multi-band antenna in the Ka band.
Figure 9:
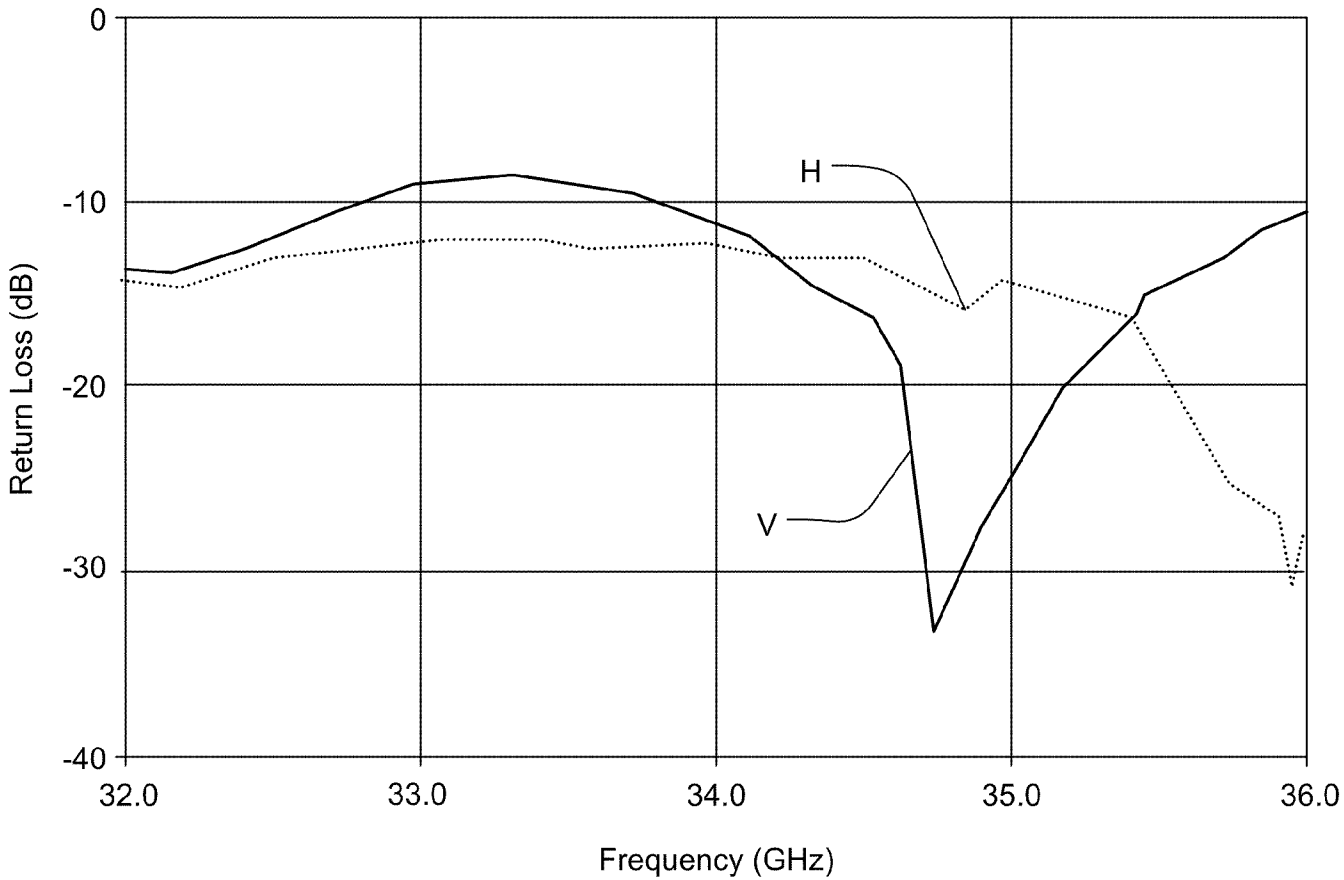
FIG. 9 is a chart showing measured performance of the exemplary dual polarization broadband/multi-band antenna in the Ka band.

FIG. 8 and FIG. 9 are graphs of the measured Ka-band performance of the prototype dual polarization broadband/multi-band antenna. As graphed in FIG. 8, the gain of the antenna is about 24 dB from 33 GHz to 36 GHz. The gain is essentially the same for both vertical and horizontal polarization. As graphed in FIG. 9, the return loss is less than −10 dB for both polarization over most of the frequency range from 32 GHz to 36 GHz.

CLOSING COMMENTS

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. A dual polarization multi-band antenna, comprising: a high band feed section having a forward end and a closed rearward end, the high band feed section comprising: a high band waveguide configured to support propagation of electromagnetic waves in a high wavelength band and to not support propagation of electromagnetic waves in a low wavelength band, and a high band vertical feed and a high band horizontal feed for coupling forward-propagating orthogonally-polarized high band electromagnetic waves into the high band waveguide; a low band feed section having a forward end and a rearward end, the low band feed section comprising: a dual band waveguide configured to support propagation of electromagnetic waves in the low wavelength band and the high wavelength band, and a low band vertical feed and a low band horizontal feed for coupling forward-propagating orthogonally-polarized low band electromagnetic waves into the dual band waveguide; a transition section coupled between the forward end of the high band feed section and the rearward end of the low band feed section, the transition section configured to couple high band electromagnetic waves from the high band waveguide to the dual band waveguide and to inhibit coupling from the low band vertical feed and the low band horizontal feed into backward-propagating low band electromagnetic waves; and a dual band waveguide horn tapering outward from a rearward end coupled to the forward end of the low band feed section to a forward end open to free space, the dual band waveguide horn configured to couple waves in the low wavelength band and the high wavelength band from the low band feed section to free space.

2. A dual polarization multi-band antenna, comprising: a high band feed section having a forward end and a closed rearward end, the high band feed section comprising: a square waveguide configured to support propagation of electromagnetic waves in a high wavelength band and to not support propagation of electromagnetic waves in a low wavelength band, and a high band vertical feed and a high band horizontal feed for coupling forward-propagating orthogonally-polarized high band electromagnetic waves into the square waveguide; a low band feed section having a forward end and a rearward end, the low band feed section comprising: a quad ridged waveguide configured to support the propagation of electromagnetic waves in the low wavelength band and the high wavelength band, and a low band vertical feed and a low band horizontal feed for coupling forward-propagating orthogonally-polarized low band electromagnetic waves into the quad ridged waveguide; a transition section coupled between the forward end of the high band feed section and the rearward end of the low band feed section, the transition section configured to couple high band electromagnetic waves from the square waveguide to the quad ridged waveguide and to inhibit coupling from the low band vertical feed and the low band horizontal feed into backward-propagating low band electromagnetic waves; and a quad ridged waveguide horn tapering outward from a rearward end coupled to the forward end of the low band feed section to a forward end open to free space, the quad ridged waveguide horn configured to coupled electromagnetic waves in the low wavelength band and the high wavelength band from the quad ridged waveguide to free space.

3. The dual polarization multi-band antenna of claim 2, wherein the low band includes frequencies from 8.0 GHz to 18.0 GHz, and the high band includes frequencies from 32 to 36 GHz.

4. The dual polarization multi-band antenna of claim 2, the low band feed section further comprising: a low band vertical probe extending into the quad ridged waveguide, and a low band horizontal probe extending into the quad ridged waveguide.

5. The dual polarization multi-band antenna of claim 4, the low band feed section further comprising: a low band vertical coaxial connector coupled to the low band vertical probe through one or more coaxial transformer; and a low band horizontal coaxial connector coupled to the low band horizontal probe through one or more coaxial transformer.

6. The dual polarization multi-band antenna of claim 2, the high band feed section further comprising: a high band vertical coaxial connector coupled to the square waveguide; and a high band horizontal coaxial connector coupled to the square waveguide.

7. The dual polarization multi-band antenna of claim 6, the high band feed section further comprising: an end wall of the square waveguide disposed to inhibit coupling from the high band vertical polarization feed into a backward-propagating vertically-polarized high band electromagnetic wave; and a plurality of shorting pins disposed to inhibit coupling from the high band horizontal polarization feed into backward-propagating horizontally-polarized high band electromagnetic waves.

8. The dual polarization multi-band antenna of claim 2, further comprising: a mounting flange proximate the back end of the high band feed section; and one or more external ribs extending from the mounting flange to the waveguide horn.

9. A dual polarization multi-band antenna, comprising: a waveguide including a high band feed section, a transition section, a low band feed section and a horn coupled in series, wherein: the high band feed section is configured to support propagation of electromagnetic waves in a high wavelength band and to not support propagation of electromagnetic waves in a low wavelength band, the transition section is configured to couple electromagnetic waves in the high band from the high band feed section to the low band feed section, and to inhibit backward propagation of electromagnetic waves in the low band the low band feed section is configured to support propagation of electromagnetic waves in the low wavelength band and the high wavelength band, and the horn is configured to couple electromagnetic waves in the low wavelength band and the high wavelength band from the low band feed section into free space, wherein the horn is a quad ridged waveguide horn; the low band feed section further comprising: a quad ridged waveguide; and a horizontal low band feed and a vertical low band feed to coupled orthogonally polarized low band electromagnetic waves into the quad ridged waveguide.

10. The dual polarization multi-band antenna of claim 9, each of the horizontal and vertical low band feeds further comprising: a probe extending into the quad ridged waveguide a connector one or more coaxial transformers to match the impedance of the connector to the impedance of the probe.

11. The dual polarization multi-band antenna of claim 9, the high band feed section further comprising: a square waveguide; a vertical high band feed to couple vertically-polarized high band electromagnetic waves into the square waveguide; a shorting wall disposed to inhibit backward propagation of vertically-polarized high band electromagnetic waves; a horizontal high band feed to couple horizontally-polarized high band electromagnetic waves into the square waveguide; and a plurality of conductive pins disposed to inhibit backward propagation of horizontally-polarized high band electromagnetic waves.

12. The dual polarization multi-band antenna of claim 11, the transition section further comprising: a quad ridge waveguide wherein a height of each ridge tapers along a length of the transition section, the ridges having a maximum height where the transition section is coupled to the low band feed section, and the ridges vanishing where the transition section is coupled to the high band feed section.

13. The dual polarization multi-band antenna of claim 12, wherein the low band includes frequencies from 8.0 GHz to 18.0 GHz, and the high band includes frequencies from 32 to 36 GHz.

* * * * *